United States Patent [19]

Routson

[11] 4,022,277

[45] May 10, 1977

[54] IN SITU SOLVENT FRACTIONATION OF BITUMENS CONTAINED IN TAR SANDS

[75] Inventor: Willis G. Routson, Walnut Creek, Calif.

[73] Assignee: The Dow Chemical Company, Midland, Mich.

[22] Filed: May 19, 1975

[21] Appl. No.: 578,778

[52] U.S. Cl. ..... 166/267; 166/276; 166/303

[51] Int. Cl.[2] ..... E21B 43/22

[58] Field of Search ..... 166/267, 272, 303, 306, 166/276

[56] References Cited

UNITED STATES PATENTS

| | | | |
|---|---|---|---|
| 2,365,591 | 12/1944 | Ranney | 166/306 |
| 2,412,765 | 12/1946 | Buddrus et al. | 166/267 |
| 2,862,558 | 12/1958 | Dixon | 166/272 |
| 3,126,961 | 3/1964 | Craig et al. | 166/306 |
| 3,386,508 | 6/1968 | Bielstein et al. | 166/303 |
| 3,838,738 | 10/1974 | Redford et al. | 166/272 |
| 3,881,550 | 5/1975 | Barry | 166/303 |

*Primary Examiner*—Ernest R. Purser
*Attorney, Agent, or Firm*—R. R. Stringham

[57] ABSTRACT

Bituminous hydrocarbons are recovered from unconsolidated tar sands by in-place, selective leaching with a hot condensate formed upon contact with hot solvent vapors injected in the formation. The composition and temperature of the vapors are regulated so that a less soluble fraction of the tar is left behind as a residue. This residue does not dissolve in the vapors passing through the already leached portion of the formation and continues to act as a sand-supporting and immobilizing agent. Thus, subsidence of the leached formation and release of sand grains (which tend to interfere with removal of the leachate from the formation) are avoided. Solvent for the process is obtainable by distillation or cracking of the produced bitumens.

10 Claims, 1 Drawing Figure

TAR SAND PRODUCTION SCHEME

IN SITU SOLVENT FRACTIONATION OF BITUMENS CONTAINED IN TAR SANDS

BACKGROUND OF THE INVENTION

1. Field of the Invention

This invention pertains to an oil recovery method, and more specifically to a method for recovering oil or petroleum from a subterranean, viscous petroleum-containing, unconsolidated formation such as a tar sand deposit.

2. Description of the Prior Art

There are known to exist throughout the world many subterranean petroleum containing formations from which the petroleum cannot be recovered by conventional means because of the relatively high viscosity thereof. The best known of such viscous petroleum containing formations are the so-called tar sands or bituminous sand deposits. The largest and most famous such deposit is in the Athabasca area in the northeastern part of the province of Alberta, Canada, which is known to contain over 700 billion barrels of petroleum. Other extensive deposits are known to exist in the western part of the United States, and Venezuela, and lesser deposits in Europe and Asia.

Tar sands are frequently defined as sand saturated with a highly viscous crude petroleum material not recoverable in its natural state through a well by ordinary production methods. The hydrocarbons contained in tar sand deposits are usually highly bituminous in character. The tar sand deposits are generally arranged as follows. Fine quartz sand is coated with a layer of water and the bituminous material occupies most of the void space around the wetter sand grains. The balance of the void volume may be filled with connate water, and occasionally a small volume of gas which is usually air or methane. The sand grains are packed to a void volume of about 35%, which corresponds to about 83% by weight sand. The balance of the material is bitumen and water. The sum of bitumen and water will almost always equal about 17% by weight, with the bitumen portion varying from around 2% to around 16%.

It is an unusual characteristic of tar sand deposits that the sand grains are not in any sense consolidated, that is to say the sand is essentially suspended in the solid or nearly solid hydrocarbon material. The API gravity of the bitumen usually ranges from about 6 to about 8, and the specific gravity at 60° F. is from about 1.006 to about 1.027. Approximately 50% of the bitumen is distillable without cracking, and the sulfur content may be as high as between 4 and 5% by weight. The bitumen is also very viscous, and so even if it is recoverable by an in situ separation technique, some on-site refining of the produced petroleum must be undertaken in order to convert it to a pumpable fluid.

Bitumen may be recovered from tar sand deposits by mining or by in situ processes. Most of the recovery to date has been by means of mining, although this is limited to instances where the ratio of the overburden thickness to tar sand deposit thickness is economically suitable, generally defined as one or less. In situ processes have been proposed which may be categorized as thermal, such as fire flooding or steam injection, and steam plus emulsification drive processes. Generation of the heat necessary to mobilize the bitumen by means of a subterranean atomic explosion has been seriously considered.

The known processes most clearly resembling that of the present invention are disclosed in U.S. Pat. Nos. 2,412,765; 3,608,638 and 3,838,738. The '765 patent discloses a process in which low boiling solvents such as propane and butane are employed to recover oil from partially depleted formations. In this process the oil recovery is made as complete as possible and the formation is a consolidated or self-supporting formation. In the process of the '638 patent a hydrocarbon solvent such as benzene, platformate or kerosene, at a temperature in the range of 300°–700° F., is injected into the top of tar sands at an injection well and forced through the formation to an adjacent production well. Injection of the solvent and production of oil are continued to maintain a gaseous phase across the top of the formation. The tar sand oil is made more mobile as a result of heating and dissolution of the solvent into the oil, whereby the oil drains into the production well and is lifted to the surface. A requirement of solvents to be used in the latter process is that the solvent is miscible in the tar sand oil without precipitating constituents in the oil. Preferred solvents are those which have good solvent properties such as aromatic hydrocarbons or mixtures of hydrocarbons containing substantial amounts of aromatic hydrocarbons. Highly parafinic hydrocarbons such as liquified petroleum gases are said not to be suitable because of their inability to dissolve the asphaltic constituents of the tar sand oil. The '738 patent is directed to a process in which petroleum is recovered from tar sand deposits by first creating a fluid communication path low in the formation. This is followed by injecting a heated fluid, aqueous or non-aqueous, into the fluid communication path. This in turn is followed by injecting a volatile solvent such as carbon disulfide, benzene or toluene into the preheated flow path and continuing to inject the heating fluid. The more volatile solvent is vaporized and moves upward into the formation where it dissolves petroleum, loses heat and condenses thereafter, flowing down, carrying dissolved bitumen with it into the preheated flow path. The low boiling point solvent effectively cycles or refluxes within the formation and is not produced to the surface of the earth. Bitumen is transferred from the volatile solvent to the heating fluid, continually passing through the communication path, and bitumen and heating fluid are recovered together as a mixture or solution.

U.S. Pat. No. 2,862,558 is less closely related to the present invention but is of interest in that viscous petroleum is recovered by this process from consolidated sandstone formations, such as the Barton tar sands, by the injection of steam and solvent vapor — kerosene vapor, for example — with what is described as improved results over the abovementioned '765 patent.

It has not been recognized in preceding patents or elsewhere in the prior art that complete removal of the hydrocarbons or bitumen from a tar sand is undesirable. When the tar content is completely removed, the remaining sand particles are not connected to each other and effectively become free-flowing. This tends to result in formation subsidence and in blockage of the pump intake and/or production line in the well by sand bridging.

Despite the many proposed methods for recovering bitumen from tar sand deposits, there has still been no successful exploitation of such deposits by in situ processing on a commercial scale up to the present time. Accordingly, in view of the lack of commercial success of any of the methods proposed to date and especially in view of the enormous reserves present in this form which are needed to help satisfy present energy needs, there is a substantial need for a satisfactory method for recovery of bitumen from tar sand deposits.

OBJECTS OF THE INVENTION

A primary object of the present invention is to provide a process in which hydrocarbons may be recovered from unconsolidated tar sands without causing formation subsidence or pump blockage. A further object of the invention is to provide an improved process for in situ recovery of hydrocarbons from tar sands in which a heated vapor is employed.

Still another object is to provide a process in which the solvent employed can be obtained from the tar formation itself.

An additional object is to provide a process which is particularly well adapted to the method wherein hot vapors are injected and the resulting tar solution is removed through the same bore.

Yet another object is to provide a relatively uncomplicated process for the recovery of bitumens from oil sands.

Further objects will be apparent to those skilled in the art.

BRIEF DESCRIPTION OF THE DRAWING

A preferred embodiment of the invention is illustrated by FIG. 1, which is a diagrammatic vertical sectional view through a single well extending through an overburden and an unconsolidated tar sand and bottoming in an underlying impermeable formation. The well is adapted for introduction of hot solvent vapors and for removal of the bitumen solution formed. Surface means for separating the solvent from the produced bitumen and returning it as hot vapors to the tar sand are included.

SUMMARY OF THE INVENTION

Figure 1:
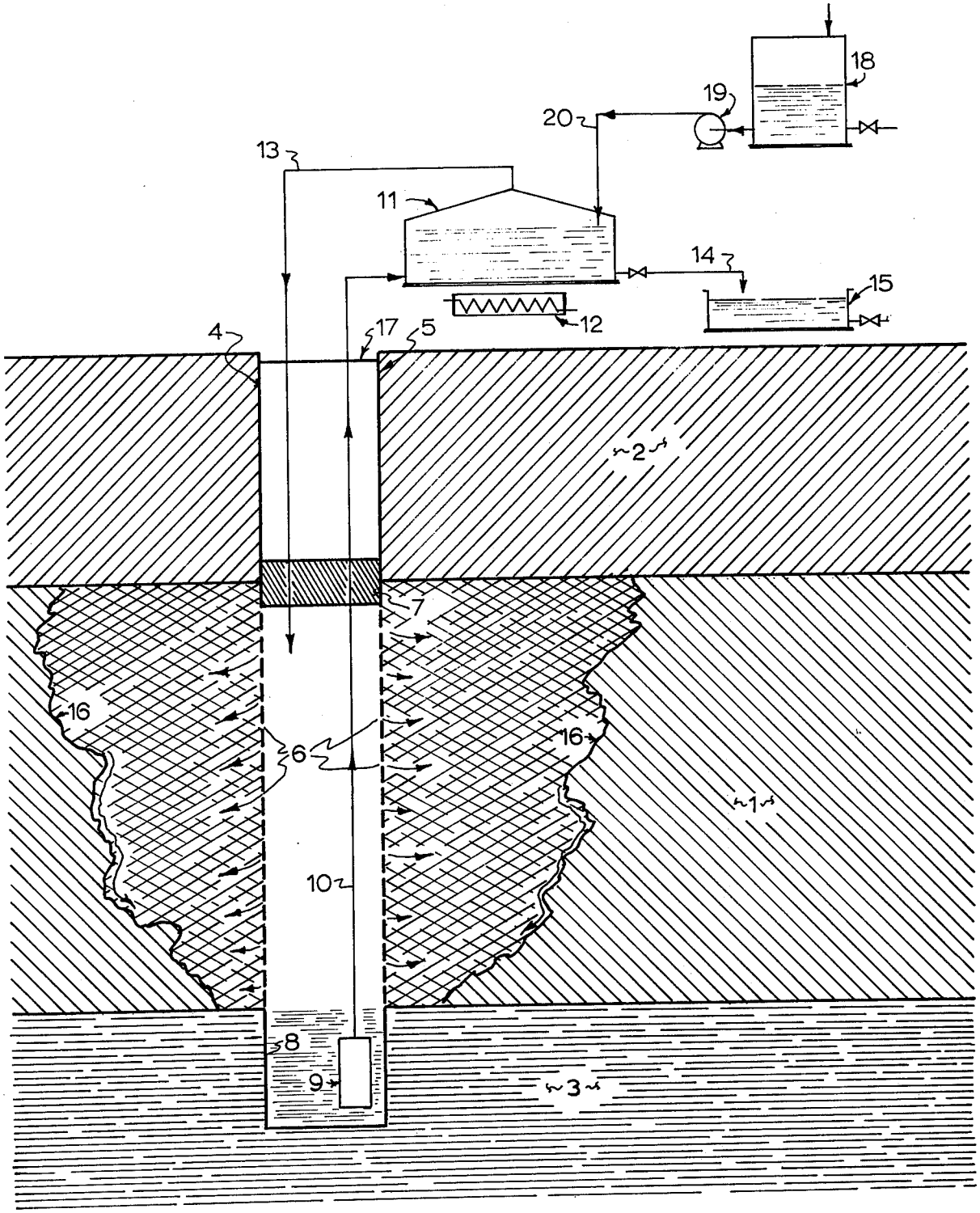

The invention is an in situ solvent fractionation process for recovering bitumens from unconsolidated tar sands, said process consisting essentially of 1. introducing hot solvent vapors in a formation consisting essentially of a bitumen-containing tar disposed among discrete sand particles,
   said vapors being so composed and at such a temperature as to condense, upon contact with unfractionated tar in said formation, to form a liquid and to selectively dissolve bitumens out of said tar as a more soluble fraction,
2. allowing the resultant solution of bitumens to drain below the level at which said hot vapors contact unfractionated tar and collecting it,
   thereby leaving in place a less soluble bituminous fraction of said tar as an undissolved residue capable of supporting itself and the sand particles among which it is disposed;
3. removing the collected solution from said formation; and
4. recovering the dissolved bitumen content of said solution.

Preferably, the process is regulated so that said undissolved residue constitutes at least 5 wt. % of the unfractionated tar.

In a particularly preferred mode of operation the vapors are introduced to, and the solution removed from, said formation, both through the same bore; optionally, said bore passes through the formation and is bottomed in an underlying strata. In this embodiment, the underlying strata is impermeable or the portion of the bore (wall and bottom) therein and the zone of contact between the layers is rendered impermeable by appropriate procedures of known types; for example, by horizontal fracturing, injection of a curable resin solution and curing.

In a continuous version of the preceding mode the solvent content of the solution is recovered, reheated, revaporized and reintroduced as hot vapors to the formation.

In a more economic and highly preferred mode of operation the hot vapors comprise a hydrocarbon obtained by distilling, cracking or otherwise treating bitumens recovered from said formation.

The temperature of the hot solvent vapors upon introduction to the formation is preferably within the range of from about 90°–150° C., most preferably within the range of 95°–120° C.

DETAILED DESCRIPTION OF THE INVENTION

The process of the present invention is characterized by the fact that the temperature of the solvent vapors introduced to the formation is the most important parameter of the process. The type or types of hydrocarbons present in the solvent is a less important parameter. However, in some instances more effective recoveries are experienced with solvents which are aromatic or which at least include some aromatics. Solvents boiling within the range of about 90°–150° C. at atmospheric pressure are preferred. Lower boiling solvents may be employed at elevated pressures. However, this is limited by the pressure exerted by the over-burden. For example, in order to obtain a boiling point over 100° C. with a solvent such as propane, pressures equivalent to more than 1000 feet of impermeable over-burden would be needed. Most of the tar sands of the world are not that deep. Also, it is preferable to operate near atmospheric pressure in order to minimize loss of the solvent vapors.

Since the bitumen is a mixture of hydrocarbon types (aliphatic, naphthenic, aromatic), the preferred solvent is a mixed solvent of the type obtained by distilling, cracking or otherwise treating the material to be dissolved. As a general rule, bitumens having a higher content of asphaltenes are more readily dissolved by aromatic solvents.

It is particularly to be noted that the present process is not directed to complete removal of the tar from the tar sand being processed. An important purpose of the present process is to essentially avoid the slumping or collapse of the formation which would result if all of the tar were removed.

Referring now to FIG. 1, a tar sand formation 1 is located between an over-burden 2 and an impermeable underlying formation 3, a well-bore indicated generally by the numeral 4 passes through the over-burden and tar sand, penetrates into the underlying layer and is bottomed therein. The well casing 5 preferably extends just deeply enough to contain and support the packer 7, located at the interface between the tar sand and over-burden. The portion 6 of bore 4 within the tar sand layer is unlined to permit facile flow of hot vapors and leachate (the solution formed by the leaching process). The portion 8 of bore 4 in the underlying layer 3 constitutes a liquid sump or reservoir into which the leachate drains. Pump 9 pumps the solution to the surface through insulated pipe 10 (which passes through packer 7). The produced bitumen solution is pumped into a still 11 heated by means 12. Solvent is distilled off and returned to the tar sand formation through an insulated line 13. The distillation bottoms, which are a concentrated solution or solvent-free, liquid bitumen, pass through pipe 14 and drains into a sump 15. Pipes 10 and 13 pass through a conventional closure member 17 at the top of the casing. As the volume of the vapor-filled portion of the tar sand formation increases, additional solvent is added as necessary from tank 18 through pump 19 and line 20. The amount of additional solvent required will be such as to provide a vapor volume equal to the liquid volume of the bitumens being recovered. The furthest point of approach of the vapors into the tar sand formation is indicated by a wavy line 16.

The hot solvent vapors are introduced to the tar sand formation at a rate such as to exert a small, preselected back pressure, preferably a few pounds per square inch gauge or less. Thus, a sufficient superheat to maintain a small temperature gradient between the point of injection of the solvent vapors into the formation and the interface between the leached and unleached portions thereof is provided. In this manner, any heat losses, such as may result from the presence of foreign bodies - shale breaks, for example — are accommodated, the temperature of the leached portion of the formation is maintained above the condensation point and further leaching of the residual tar is avoided.

When all the bitumen is extracted from a true tar sand, the residual sand has no inherent strength and crumbles. Some of the so-called "tar sand" formations are actually sandstone formations similar to an oil-bearing sand formation. This rock type is not as readily extracted by the vapor solvent method. Tests of this method on plugs cored from asphalt rocks gave a maximum recovery of only 30–50% with any of the usual solvents.

For efficient bitumen recovery by the present method, a plurality of closely-spaced wells is drilled into the tar sand formation. The spacing selected will depend somewhat on the depth and thickness of the formation but on the average will be within the range of about 25–200 feet. These wells may function both to supply hot vapors to the formation and to recover the solution formed therefrom, or, alternatively, some wells may be used for vapor input until breakthrough to an adjacent well has occurred. Thereafter, the adjacent well may be used for solution recovery.

When the portion of the tar sand formation which is penetrated by the wells has been leached until further bitumen recovery would be uneconomic or would cause collapse of the sand, introduction of hot vapors is discontinued and the solvent is recovered from the formation by flooding with water. This cools the formation and condenses any vapors, the vapors amounting to about one pound of solvent per barrel of porous base, depending upon the molecular weight of the solvent.

It should be noted that limited coproduction of sand and a corresponding degree of formation slumping in the vicinity of the well bore(s) can be anticipated in the practice of the present invention (which is not predicated on the complete avoidance of these effects). However, the temperature and solvent composition required to substantially avoid such effects can be determined by laboratory tests (such as in the following examples) carried out on samples of the tar sand formation to be leached. Allowance must of course be made for the fact that the proportion of sand in a small sample lost (coproduced) will be substantially larger than in leaching of the tar sand in place.

In some instances, it may be adviseable to extend the casing (element 5 in the drawing) down to the bottom of the bore (element 4), as a foraminous section adapted to act as a sand filter, thereby counteracting any tendency for subsidence to occur around the bore.

EXAMPLE 1

Solvent Effectiveness Tests

An open-top container is set up with boiling solvent in the bottom, a cooling coil around the top for a condenser, and an opening so that a sample in a wire screen basket can be lowered into the heated vapors. Any solvent condensing on the sample runs down through the screen and is caught in an aluminum dish suspended below the basket but above the liquid. Samples are prepared from irregular small pieces of the tar sand by placing them in a mold and compressing them to 6000 psi to form a cylinder about 1-inch long and 1-inch in diameter. The tared sample in the wire basket is lowered into the solvent vapors until no more condensation occurs, usually less than one-half hour. Then the sample is removed, cooled and weighed. Any sand removed with the solvent is separated and weighed and the residual sand (the leached sample) is weighed. The sum of these weights is subtracted from the original sample weight to find the weight of the tar extracted from the sample. The leached sand sample from the basket is then broken down and thoroughly washed with Chlorothene (1,1,1-trichloroethane) to remove any residual tar. The final sand weight is used to calculate the original total tar content and then the percent recovered by the solvent vapor being tested.

Cores cut from undisturbed tar sands are also extracted by this method and the results are comparable, within experimental error, to those obtained with the pressure molded samples.

Solvents of different types and having different boiling points were tested with five different tar sands and one asphalt rock.

The vapor compositions and temperatures employed and the results obtained are given in the following table.

(Samples suspended in steam vapor at 100° C. for an hour gave no recovery. The sample did not even slump. Heating the sample for 2 hours at 200° C. also gave no recovery.)

TABLE I

EFFECT OF SOLVENT COMPOSITION AND VAPOR TEMPERATURE ON BITUMEN RECOVERY PERCENTS OF TAR (AND SAND) LEACHED (AND LOST) FROM SAMPLE

| Solvent Component | Proportion (Percent) | Boiling Temp. | Athabasca, Canada Tar (Sand) | Edna, Calif. Tar (Sand) | Santa Cruz, Calif. Tar (Sand) | Asphalt Ridge, Utah Tar (Sand) | P. R. Springs, Utah Tar (Sand) | Sunnyside, [3] Utah Tar |
|---|---|---|---|---|---|---|---|---|
| Pentane | 100 | 36° C. | 0 | (0.9) | | | | |
| Hexane | 100 | 69 | 46 (2.0) | | | | | |
| Benzene | 100 | 81 | 37 (5.7) | | | | | |
| Hexane / Heptane | 50 / 50 | 80–83 | 57 (9.8) | | | | | |
| Hexane / Xylene | 50 / 50 | 85 | 76 (7.2) | | | | | |
| Benzene / Octane | 75 / 25 | 86 | 50 (9.9) | | | | | |
| Benzene / Toluene | 75 / 25 | 86–87 | 60 (8.5) | | | | | |
| Benzene / Xylene | 75 / 25 | 86–88 | 52 (4.3) | | | | | |
| Hexane / Toluene | 50 / 50 | 86–90 | 70 (16.6) | 27 (2.4) | 43 (3.8) | 36 (20.6) | 11 (0.2) | 20 |
| Hexane / Heptane | 25 / 75 | 90 | 88 (13.4) | | | | | |
| Benzene / Octane | 50 / 50 | 94 | 94 (12.2) | | | | | |
| Heptane | 100 | 99 | 81 (13.0) | | 41[1](3.7) | 78 (39.8) | 51 (0.0) | 25 |
| Benzene / Toluene | 50 / 50 | 99 | 94 (9.9) | | | | | |
| Iso-octane | 100 | 100 | 95 (0.8) | | | | | |
| Heptane / Toluene | 50 / 50 | 103 | 97 (37.1) | 46 (10.8) | 64 (13.6) | 88 (29.8) | 46 (0.3) | 39 |
| Iso-octane / Toluene | 50 / 50 | 104 | 96 (32.3) | | | | | |
| Toluene | 100 | 111 | 96 (28.3) | 78 (26.3) | 76 (7.2) | 51;64[2] (13.1) | 61 (0.9) | 36 |
| Octane / Toluene | 50 / 50 | 115 | 96 (41.2) | 92 (19.0) | 91 (8.4) | 87 (25.2) | 95 (12.1) | 32 |
| Iso-octane / Xylene | 50 / 50 | 116 | 97 (34.4) | | | | | |
| Heptane / Xylene | 50 / 50 | 117 | 96 (25.4) | | | | | |
| Heptane / Xylene | 25 / 75 | 122 | 98 (38.2) | | | | | |
| Octane | 100 | 127 | 96 (21.2) | 96 (24.4) | 88[1](9.8) | 89 (33.9) | 96 (9.1) | 48 |
| Octane / o-xylene | 50 / 50 | 131 | 98 (55.7) | | | | | |
| m-xylene | 100 | 139 | 98 (40.9) | | | | | |
| p-xylene | 100 | 139 | 93 | 96.5(31.5) | 99 (26.6) | 90 (31.6) | | 52 |
| Decane | 100 | 175 | 98 (55.6) | | | | | 53 |
| Pentadecane | 100 | 254 | 100[4] | | | | | |

NOTES:
[1]Aliphatic solvent anomaly
[2]Aromatic solvent anomaly
[3]Asphalt rock; cut cores
[4]Sand collapse resulted.

The preceding tests, surprisingly, indicated that the boiling point of the solvent is more critical for extraction than the type or types of hydrocarbon in the solvent. Solvents boiling above 90° C. recovered more than 90% of the bitumen from Athabasca tar sand and solvents boiling at or above 115° C. recovered 90% or more bitumen from the two California tar sands tested. On the other hand, solvents boiling below 80° C. recovered less than 50% of the bitumen in all cases and below 50° C. there was almost no recovery.

Samples from the Santa Cruz area in California did show some solvent type discrimination. Pure naphthenic solvents were 10–20% less effective than aromatic or mixed solvents of the same boiling points. This presumably is attributable to the higher asphaltene content of the Santa Cruz tar sands. In contrast, bitumen from Asphalt Ridge, Utah did not extract as well with aromatics as with aliphatics at corresponding temperatures.

EXAMPLE 2

A laboratory experiment was devised to approximate field conditions and estimate production rates. A core four inches in diameter and four inches high with a five-eighth inch diameter center hole was formed in the shape of a doughnut by compressing Athabasca tar sand fragments into an appropriate mold at 2500 psi. This sample was extracted by injecting a 50/50 mixture of toluene and heptane vapors into the top of the center opening and removing condensed solvent and extracted tar at the bottom through a liquid trap.

The rate of bitumen production was measured and extrapolated to estimate the rate of production that could be expected from an actual producing well. Extrapolation was based on the ratio of surface area exposed in a well 12 inches in diameter through 100 feet of tar sand formation, compared to the surface exposed in the hole of the laboratory sample. This ratio is about 5420:1. After the flows stabilized, the recovery rate was 0.3 to 0.5 ml/min. which translates to about 15–25 barrels per day for a 100 foot pay zone.

Another 4 inch doughnut-shaped core was divided into three layers by impermeable membranes placed horizontally and spaced vertically at equal intervals within the core to simulate shale breaks in a formation. When this core was extracted by the above method, the recovery rate was about 0.2 ml/min. or equivalent to 10 B/D, a 30% reduction in output.

It is to be understood that the practice of the present invention is not limited to the examples given herein and is limited only as defined by the following claims.

I claim:

1. An in-situ solvent fractionation process for recovering bitumens from unconsolidated tar sands, said process consisting essentially of 1. introducing hot solvent vapors in a formation consisting essentially of a bitumen-containing tar disposed among discrete sand particles, said vapors being so composed and at such a temperature as to condense, upon contact with unfractionated tar in said formation, to form a liquid and to selectively dissolve bitumens out of said tar as a more soluble fraction, 2. allowing the resultant solution of bitumens to drain below the level at which said hot vapors contact unfractionated tar and collecting it, thereby leaving in place a less soluble bituminous fraction of said tar as an undissolved residue capable of supporting itself and the sand particles among which it is disposed;

3. removing the collected solution from said formation; and
4. recovering the dissolved bitumen content of said solution.

2. The process of claim 1 wherein the temperature and composition of said vapors are regulated so that said undissolved residue constitutes at least 5 weight percent of the unfractionated tar.

3. The process of claim 1 in which the solvent content of the solution is recovered, reheated, revaporized and reintroduced as said hot vapors to said formation.

4. The process of claim 1 in which said hot vapors comprise a hydrocarbon obtained by distilling, cracking or otherwise treating bitumens recovered from said formation.

5. The process of claim 1 in which the temperature of said hot solvent vapors upon introduction to said formation is within the range of from about 90° to about 150° C.

6. The process of claim 1 wherein the hot vapors are introduced under a small positive pressure of from about 0.5 to about 5 psig.

7. The process of claim 1 in which said solvent vapors are a mixture of vapors of an aromatic solvent which is benzene, toluene, xylene or mixtures thereof and of an aliphatic solvent which is heptane, octane, nonane, decane or mixtures thereof.

8. The process of claim 7 wherein the mole ratio of aliphatics to aromatics in said vapors is within the range of from about 60/40 to about 40/60.

9. The process of claim 1 in which said vapors are introduced to and said solution removed from said formation, both through the same bore.

10. The process of claim 9 in which said bore passes through said formation and is bottomed in an underlying impermeable strata.

* * * * *